United States Patent [19]

Tacchetto

[11] Patent Number: 5,062,224

[45] Date of Patent: Nov. 5, 1991

[54] SKI BOOT WITH VARIABLE-INCLINATION UPPER SPOILER

[75] Inventor: Maurizio Tacchetto, Noventa Padovana, Italy

[73] Assignee: Nordica S.p.A., Montebelluna, Italy

[21] Appl. No.: 611,592

[22] Filed: Nov. 13, 1990

[30] Foreign Application Priority Data

Dec. 21, 1989 [IT] Italy ..... 82627 A/89

[51] Int. Cl.[5] ..... A43B 5/04

[52] U.S. Cl. ..... 36/117

[58] Field of Search ..... 36/117, 118, 119, 120, 36/121

[56] References Cited

U.S. PATENT DOCUMENTS

| | | | |
|---|---|---|---|
| 4,669,202 | 6/1987 | Ottieri | 36/117 |
| 4,677,768 | 7/1987 | Benoit et al. | 36/117 |
| 4,680,878 | 7/1987 | Pozzobon et al. | 36/117 |
| 4,698,920 | 10/1987 | Benoit et al. | 36/119 |
| 4,719,710 | 1/1988 | Pozzobon | 36/119 |
| 4,756,099 | 7/1988 | Walkhoff | 36/120 |

*Primary Examiner*—Paul T. Sewell
*Assistant Examiner*—M. Denise Patterson
*Attorney, Agent, or Firm*—Guido Modiano; Albert Josif

[57] ABSTRACT

The ski boot includes a front quarter and a rear quarter associated with a shell, as well as a first device and a second device which are distinct and adjacent and separately secure the foot inside the boot and close the quarters. The rear quarter has, in a rearward position, a perimetric edge which is depressed upward and at which an end of a flap is arranged; one of the first or second devices being associated with the end of the flap. The flap and/or the first device and/or the second device are thus pivoted, along at least one transverse axis, to the rear quarter.

5 Claims, 1 Drawing Sheet

SKI BOOT WITH VARIABLE-INCLINATION UPPER SPOILER

BACKGROUND OF THE INVENTION

The present invention relates to a ski boot of the type which comprises at least a front quarter and a rear quarter associated with a shell as well as a first device and a second device which are distinct and adjacent and separately secure the foot inside the boot and/or close the quarters.

Closure devices are currently known having a first and second device arranged adjacent at the rear part of the rear quarter; said known devices thus allow for example to tighten separate regions of the boot.

Ski boots are also known which are provided with a variable-inclination flap or upper rear spoiler pivotally articulated at the rear quarter in order to be easily put on.

Such flap, however, limits the room available for the above mentioned device, also because regulations forbid to arrange a closure assembly below a certain height.

SUMMARY OF THE INVENTION

The aim of the present invention is to eliminate the disadvantages described above in known ski boots and to provide a rear-entry boot which has connected at the rear quarter at least a first device and a second device, which are adjacent and separate, for securing the foot inside the boot and/or closing the quarters, together with a variable-inclination flap or upper rear spoiler.

Within the scope of the above described aim, an important object is to provide a structurally simple ski boot having a pleasant aesthetic aspect and compact dimensions.

Another object is to facilitate the production of the boot and make it, at the same time, safe and reliable in use.

A further object of the present invention is to provide a boot which has low production costs.

This aim, these objects and others which will become apparent hereinafter are achieved by a ski boot, comprising at least a front quarter and a rear quarter associated with a shell, as well as a first device and a second device, said devices being distinct and mutually adjacent and being adapted to separately secure the foot inside said boot and close said quarters, characterized in that said rear quarter has, in a rearward position, a perimetric edge which is depressed upward and at which an end of a flap if placed, one of said first or second devices being associated with said flap, said flap and/or said first device and/or said second device being pivoted along at least one axis which is transverse to said rear quarter.

BRIEF DESCRIPTION OF THE DRAWINGS

Further characteristics and advantages of the invention will become apparent from the detailed description of a preferred but not exclusive embodiment, illustrated only by way of non-limitative example in the accompanying drawings, wherein.

DESCRIPTION OF THE PREFERRED EMBODIMENTS

Figure 3:
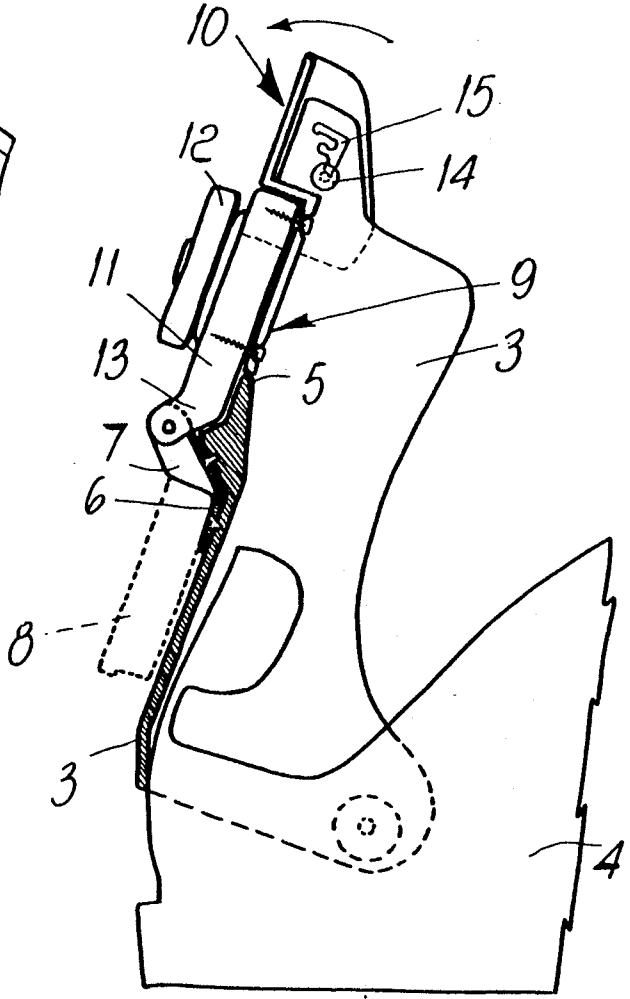
FIG. 3 is a sectional side view of the boot taken along a sectional plane which is median and longitudinal with respect to the rear quarter.
Figure 2:
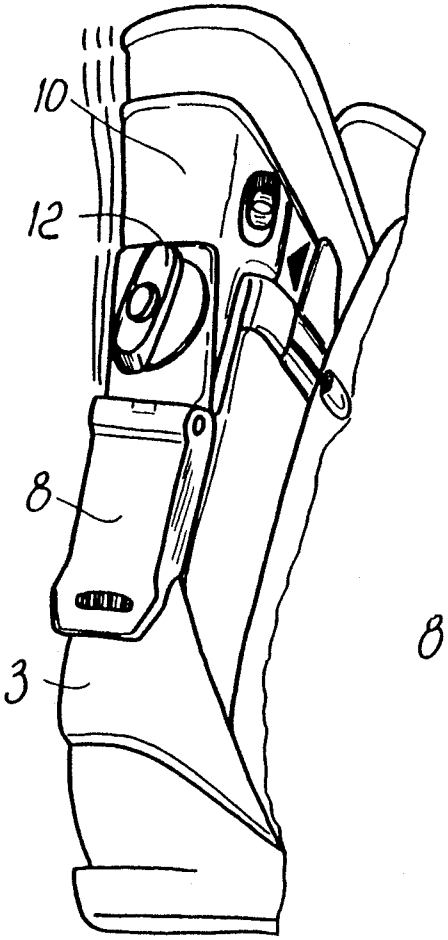
FIG. 2 is a view, similar to the preceding one, of the variation of the position which can be assumed by the flap in the reclined condition.
Figure 1:
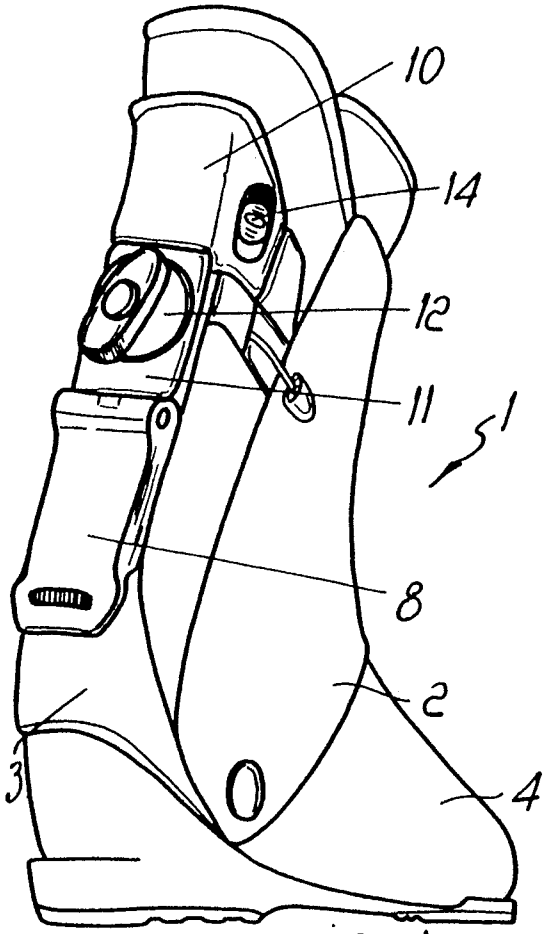
FIG. 1 is an isometric rear view of the boot according to the invention, with the flap inclined.

With reference to the above figures, the reference numeral 1 indicates the ski boot which is constituted by a front quarter 2 and by a rear quarter 3 articulated to a shell 4.

The rear quarter 3 has, in its rear part, a depressed upper perimetric edge 5, and a preferably metallic base 6 is associated proximate thereto; a first device, preferably for the closure of the quarters and constituted by a lever 8 having adapted means for the takeup of one or more first traction elements, is transversely pivoted to a pair of brackets 7 of said base.

The end 9 of a flap or upper rear spoiler 10 can be placed above the upper perimetric edge 5 of the rear quarter 3, and a second device 11, preferably of the circular type and therefore comprising a knob 12 associated with a winder for the takeup of one or more second traction elements adapted to secure the foot, is associated at the outer rear surface of said flap 10.

Said second device 11 advantageously has, at one end, an extension or tab 13 for its articulation to the pair of brackets 7, preferably at the same axis of articulation as the lever 8.

Advantageously, the flap 10 is associated laterally with the rear quarter 3 and has means adapted to adjust its inclination, such as at least one slider 14 which is slidable at an adapted guide 15 which is defined laterally to said rear quarter 3.

The operation of the ski boot is therefore as follows: the adjustment of the inclination, achieved by means of the slider 14 and the guide 15, corresponds to a backward rotation of the flap 10 together with that of the second device 11.

The fact of associating the second device 11 directly at the flap, freeing the rear quarter in this region, in fact allows to also use in combination a first lever device, preferably for the closure of the quarters, articulating said quarters preferably along the same axis.

It has thus been observed that the invention has achieved the intended aim and objects, a boot having been obtained which allows to place at the rear quarter both a first device and a second device which are adjacent and mutually distinct, so as to secure the foot and/or close the quarters, together with a variable-inclination flap or upper rear spoiler for adjusting the rear resting.

The boot according to the invention is furthermore structurally very simple and leaves the aesthetic structure of the boot practically unchanged in that it has no particular expansions or depressions.

The invention is susceptible to numerous modifications and variations, all of which are within the scope of the same inventive concept.

Thus, for example, the flap can be pivoted, at one end, transversely to the rear quarter, the second device being supported rigidly on said flap.

The first device, the second device and the flap can furthermore be mutually pivoted or not according to one or more distinct parallel axes.

The materials and the dimensions which constitute the individual components of the boot may be the most pertinent according to the specific requirements.

I claim:

1. Ski boot with a variable-inclination upper spoiler, said ski boot comprising a shell, and a front quarter and a rear quarter both articulated to said shell, said rear quarter comprising a lower part and said upper spoiler, said lower part of said rear quarter being pivotally articulated to said shell, said upper spoiler being pivoted exclusively to said lower part at a transverse axis defined on said lower part, said ski boot further comprising a first adjustment device and a second adjustment device, said first adjustment device and said second adjustment device both being connected to said rear quarter, wherein said first adjustment device is arranged at said lower part of said rear quarter and said second adjustment device is arranged at said upper spoiler.

2. Boot according to claim 1, wherein said first adjustment device is a pivoting lever having first traction elements connected thereto for closing together said front and rear quarters around a user's lower leg regions.

3. Boot according to claim 1, wherein said second adjustment device is a circular winding device having second traction elements connected thereto for securement of a user's foot inside said boot.

4. Ski boot with a variable-inclination upper spoiler, said ski boot comprising a shell, and a front quarter and a rear quarter both articulated to said shell, said rear quarter comprising a lower part and said upper spoiler, said lower part of said rear quarter being pivotally articulated to said shell, said upper spoiler being pivoted exclusively to said lower part at a transverse axis defined on said lower part, said ski boot further comprising a first adjustment device and a second adjustment device, said first adjustment device and said second adjustment device both being connected to said rear quarter, wherein said first adjustment device is arranged at said lower part of said rear quarter and said second adjustment device is arranged at said upper spoiler, said first adjustment device being a pivoting lever having first traction elements connected thereto for closing together said front and rear quarters around a user's lower leg regions, said pivoting lever being pivoted to said rear quarter at said transverse axis where said upper spoiler is also provided to said lower part.

5. Ski boot with a variable-inclination upper spoiler, said ski boot comprising a shell, and a front quarter and a rear quarter both articulated to said shell, said rear quarter comprising a lower part and said upper spoiler, said lower part of said rear quarter being pivotally articulated to said shell, said upper spoiler being pivoted to said lower part at a transverse axis defined on said lower part, said ski boot further comprising a pivoting lever having traction elements connected thereto for closing together said front and rear quarters around a user's lower leg regions, said pivoting lever being pivoted to said rear quarter at said transverse axis where said upper spoiler is also pivoted to said lower part.

* * * * *